US005095841A

United States Patent [19]

Santos et al.

[11] Patent Number: 5,095,841

[45] Date of Patent: Mar. 17, 1992

[54] UNDERWATER MOORING SYSTEM USING AN UNDERWATER TRACTION WINCH

[75] Inventors: Gerald M. Santos, Little Compton; Robert A. Connerney, Newport, both of R.I.

[73] Assignee: The United States of America as represented by the Secretary of the Navy, Washington, D.C.

[21] Appl. No.: 607,348

[22] Filed: Oct. 30, 1990

[51] Int. Cl.[5] ..... B63B 21/52

[52] U.S. Cl. ..... 114/230; 441/4

[58] Field of Search ..... 441/1, 3, 4, 5, 21, 441/22, 23, 24, 25, 26, 32, 33

[56] References Cited

U.S. PATENT DOCUMENTS

| | | | |
|---|---|---|---|
| 3,425,069 | 2/1969 | Christians | 441/3 |
| 3,728,748 | 4/1973 | Roehler | 441/23 |
| 3,775,787 | 12/1973 | Rager | 441/23 |
| 4,215,572 | 8/1980 | Spiess | 441/23 |
| 4,535,430 | 8/1985 | Cochrane et al. | 441/23 |

*Primary Examiner*—Jesus D. Sotelo
*Assistant Examiner*—Stephen P. Avila
*Attorney, Agent, or Firm*—Michael J. McGowan; Prithvi C. Lall; Michael F. Oglo

[57] ABSTRACT

An underwater mooring system using an underwater traction winch for adjusting an underwater sensor array is provided. A main mooring buoy, moored to the sea bed by a plurality of mooring cables, serves as the mounting point for an underwater traction winch as well as the mooring point for a sensor array maintained afloat above the main mooring buoy. In one embodiment, depth adjustment is achieved by using the traction winch to alter the length of the mooring cable connecting the sensor array to the main mooring buoy. In another embodiment, depth adjustment is achieved by using the traction winch to alter the length of one of the mooring cables fixed to the sea bed.

16 Claims, 4 Drawing Sheets

UNDERWATER MOORING SYSTEM USING AN UNDERWATER TRACTION WINCH

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention generally relates to underwater mooring systems and more particularly to an underwater mooring system using an underwater traction winch.

(2) Description of the Prior Art

Underwater sensor arrays maintained afloat by buoys are typically moored by a number of mooring cables secured to the sea bed. When it becomes necessary to adjust the depth of the sensor arrays, the lengths of the mooring cables must be adjusted. Prior art systems for adjusting lengths of deployed wire, cables, or ropes underwater have included the use of underwater winches. These winches store all of the adjustable line on the winch drum and therefore require a complex level wind mechanism. There is also the possibility of developing overriding turns on the drum which ultimately jams the winch.

Additionally, adjusting the mooring depth of sensor arrays in deep water or remote locations makes it impossible to use a surface supported diver or scuba diver for safety or logistical reasons, thereby requiring the use of the aforementioned underwater winches. In these situations, when the underwater winches become jammed, it is necessary to either retrieve the entire mooring or use an expensive submersible vehicle to clear the jam.

SUMMARY OF THE INVENTION

Accordingly, it is an object of the present invention to develop an underwater mooring system for adjusting the depth of an underwater object such as a sensor array without the use of divers or submersible vehicles.

It is a further object of the present invention to develop an underwater mooring system provided with adjustable length mooring cables.

Yet another object of the present invention is to develop an adjustable underwater mooring system that is of simple construction.

Other objects and advantages of the present invention will become more apparent hereinafter in the specification and drawings.

The invention is a new and novel system for mooring a sensor array to a sea bed and for adjusting the depth of the sensor array. A plurality of mooring pads are fixed to the sea bed. A main mooring buoy, located underwater, is in mechanical communication with a plurality of mooring cables. A first mooring cable is attached to a sensor array floating above the main buoy. Positioning of the sensor array is maintained by a floatation buoy attached thereto. The remainder of the mooring cables are fixed to the mooring pads. A motor-driven traction type winch, located at the main buoy, is wrapped with either 1) the mooring cable attached to the sensor array or 2) one of the remainder mooring cables fixed to a mooring pad. In the first instance, the sensor array mooring cable is winched while in the second instance, a mooring cable fixed to a mooring pad is winched. In either case, a counterweight is attached to the winched cable for applying tension throughout the winched cable.

DESCRIPTION OF THE PREFERRED EMBODIMENTS

Figure 1:
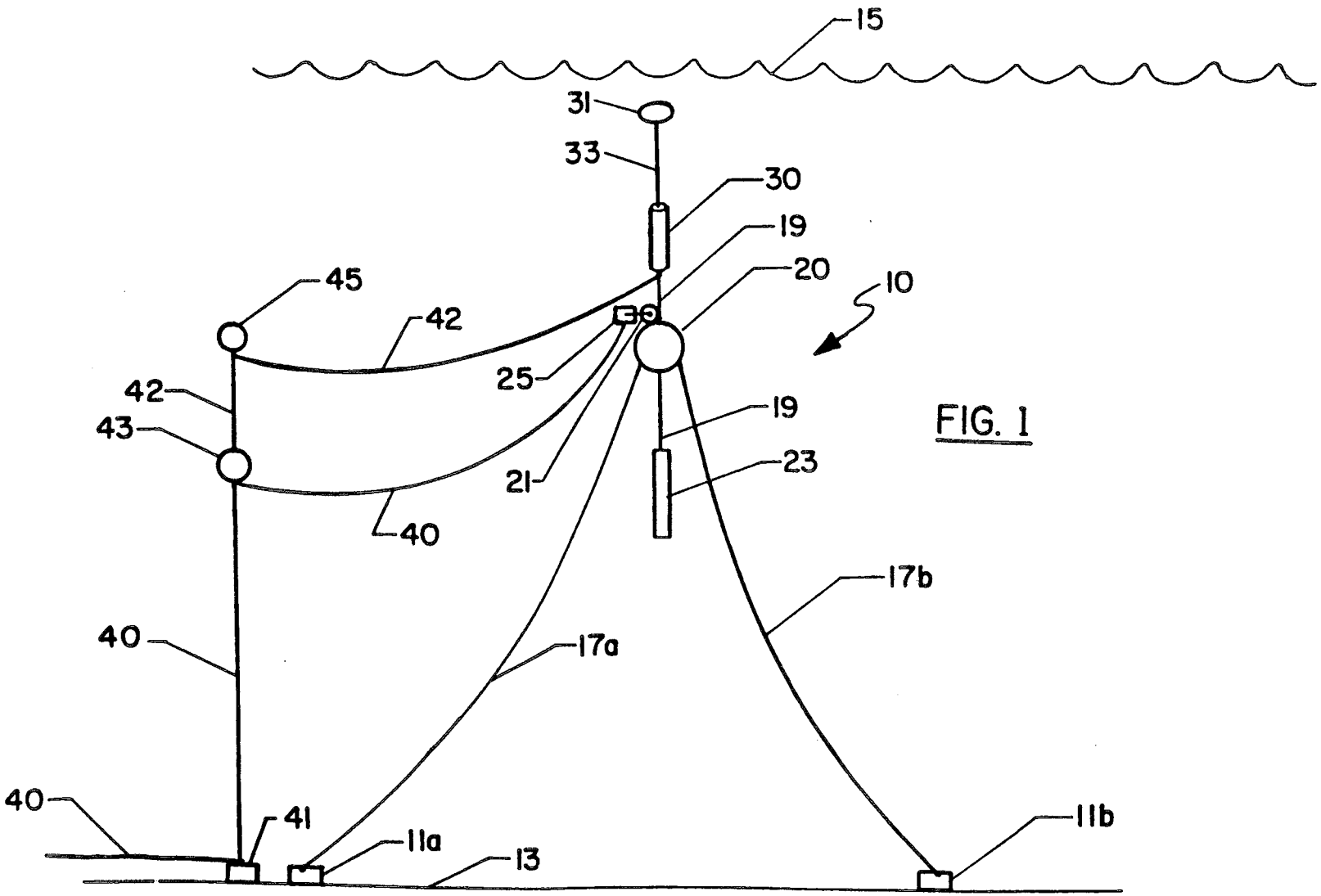
FIG. 1 depicts a mooring system having a winched sensor array mooring cable according to the present invention.

Referring now to the drawings and in particular to FIG. 1, a first embodiment of a mooring system 10 is shown according to the present invention. Two mooring pads 11*a* and 11*b* are placed on a sea bed 13. Although more mooring pads may be used, two are shown for ease of description. A main mooring buoy 20 is held in place underneath the water surface 15 by two mooring legs 17*a* and 17*b*. Each of the two mooring legs 17*a* and 17*b* are fixed to mooring pads 11*a* and 11*b*, respectively, and main mooring buoy 20 as shown. Mooring legs 17*a* and 17*b* are typically made from flexible wire, synthetic fiber, rope or a combination thereof. Accordingly, mooring legs 17*a* and 17*b* are shown as a catenary and will hereinafter be referred to as mooring cables 17*a* and 17*b*. Another mooring leg or cable 19 is attached to a sensor array 30. For purposes of description only, sensor array 30 is an underwater acoustical sensor array. However, the system of the present invention will just as easily function to moor and adjust the depth of any underwater object in place of sensor array 30.

Mooring cable 19 wraps around a traction winch 21, attached to main mooring buoy 20, and then is attached to a counterweight 23. A floatation buoy 31 is connected to sensor array 30 to maintain position of sensor array 30 above the main mooring buoy 20. An underwater motor 25 is provided to rotate traction winch 21. However, the mooring system of the present invention could function without a motor 25. For example, if it was desired to maintain sensor array 30 at a constant depth with respect to the surface 15, counterweight 23 could be chosen to balance the buoyant forces acting on floatation buoy 31. In such a case, no motor would be required. With or without the motor 25, the depth of sensor array 30 is adjusted when traction winch 21 rotates as will be described further herein below.

Typically, motor 25 receives its power and control signals via a power and signal cable 40. Cable 40 travels from the shore to a mooring pad 41 fixed to the sea bed 13. In order to prevent cable 40 from becoming entangled with mooring cables 17*a*, 17*b* and 19, cable 40 is attached to a power and signal cable buoy 43 positioned such that the catenary formed between cable buoy 43 and motor 25 resides above the catenary formed by mooring cable 17*a*. Similarly, should sensor array 30 require power and signal lines, cable 40 would include these. Once again, in order to prevent entanglement with any of the aforementioned mooring or power and signal cables, a branch 42 of cable 40 is attached to an upper power and signal cable buoy 45 before being connected to sensor array 30.

Figure 2:
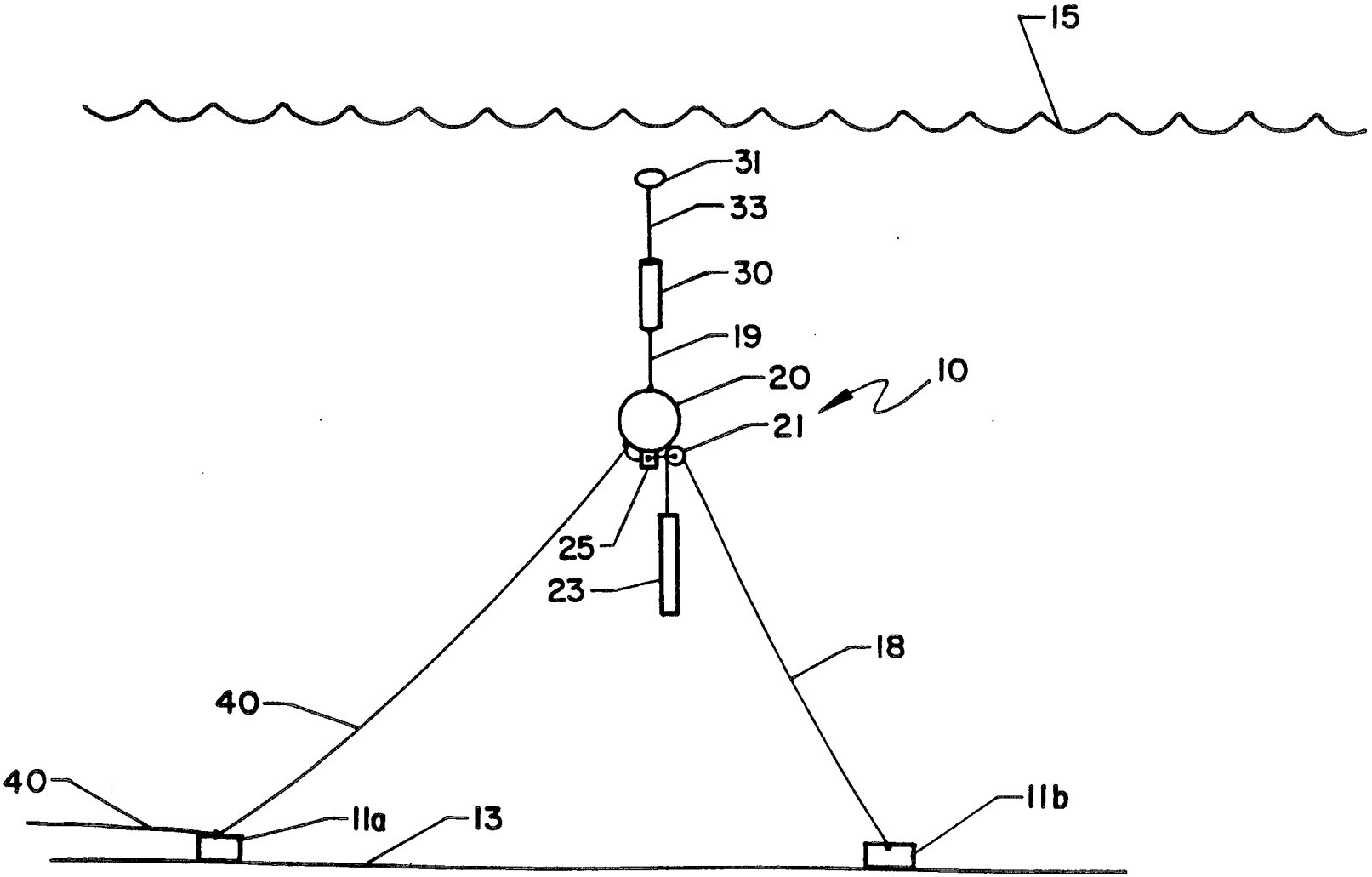
FIG. 2 depicts an alternative mooring system having a winched mooring cable fixed to a mooring pad according to the present invention.

An alternative embodiment of the present invention is shown in FIG. 2 where like reference numerals are used to depict those elements common with the first embodiment of FIG. 1. In the embodiment of FIG. 2, power and signal cable 40 is used to moor main mooring buoy 20 to a mooring pad lla. Mooring cable 19 is fixed to both sensor array 30 and main mooring buoy 20 and may be used to carry power and signal lines from cable 40 to sensor array 30. Traction winch 21 is attached to main mooring buoy 20. A mooring cable 18, fixed on one end to mooring pad 11*b*, wraps around traction winch 21 and is then attached to counterweight 23. In this alternative embodiment, the depth of sensor array 30 is adjusted when traction winch 21 rotates to raise or lower main mooring buoy 20.

Figure 3:
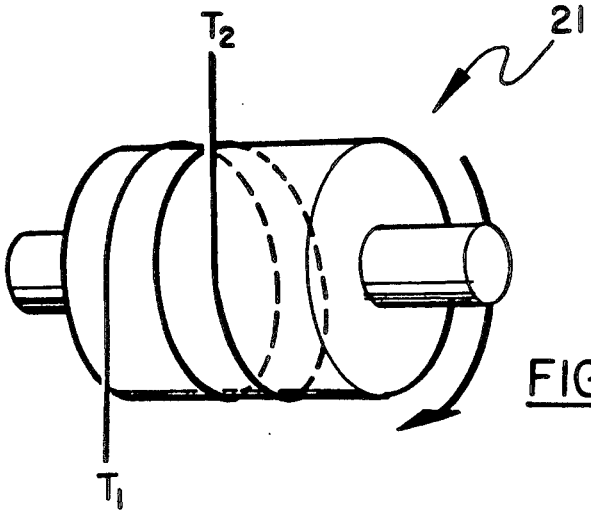
FIG. 3 is a diagrammatic representation of a single drum traction winch.
Figure 4:
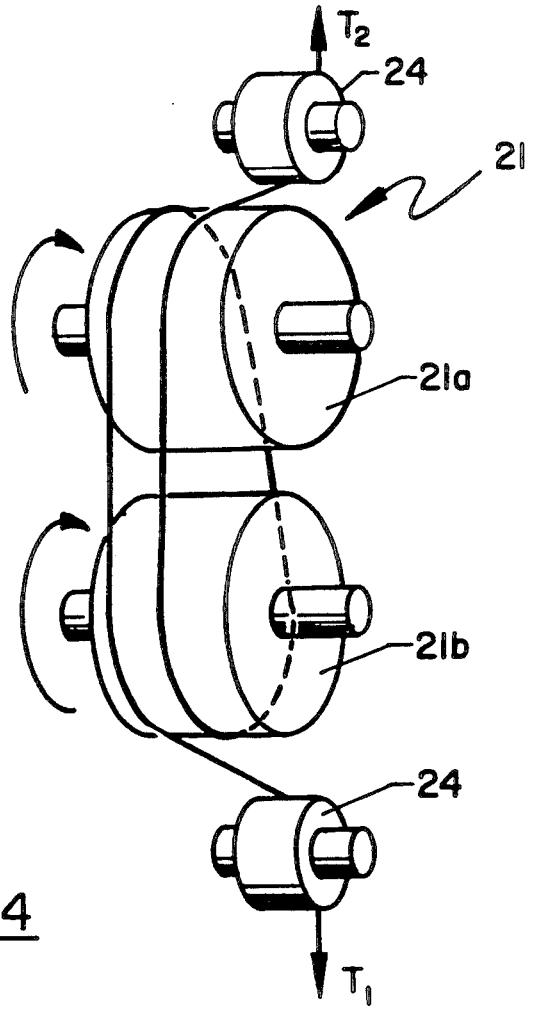
FIG. 4 is a diagrammatic representation of a double drum traction winch.

Traction winch 21 may be a single drum traction (capstan) winch or a double drum traction winch shown in FIGS. 3 and 4, respectively. The single or double drum traction winch is a common traction device. The governing equation for these devices if acceleration of the masses is ignored is:

$$T_1 = (T_2)e^{fa} \quad (1)$$

where $T_1$ = tension in the loaded end of the cable attached to counterweight 23;

$T_2$ = tension in cable 19 (FIG. 1) or 18 (FIG. 2);

e = Naperian base = 2.71;

a = total angle of wrap in radians; and f = the coefficient of friction between the cable and drum.

For the embodiment shown in FIG. 1, tension $T_1$ caused by counterweight 23 is selected to offset the tension $T_2$ in the section of mooring cable 19 between winch 21 and sensor array 30. It is desirable to minimize the size of counterweight 23 in order to maintain the tension in mooring legs 17*a* and 17*b* while balancing the tension in mooring cable 19. This is achieved by choosing a floatation buoy 31 that is much smaller than mooring buoy 20.

For the embodiment shown in FIG. 2, tension $T_1$ caused by counterweight 23 is selected to offset the tension $T_2$ in the section of mooring cable 18 between winch 21 and mooring pad 11*b*. In this second embodiment, the tension $T_1$ is greater than in the first embodiment due to the large buoyancy force required to suspend signal cable 40 and mooring cable 18. Balancing this higher tension $T_2$ with counterweight 23 is less efficient because it adds a significant amount of weight to the entire system. The increased weight reduces net buoyancy thereby increasing the catenary in signal cable 40 and mooring cable 18 Accordingly, for this embodiment, counterweight 23 only provides the necessary back tension required for winch operation.

Assuming the same lifting velocity for either embodiment, the line load will be greater for the second embodiment in FIG. 2 than the first embodiment in FIG. 1 due to the inefficiencies inherent with using a larger counterweight 23 in the design of the second embodiment. Accordingly, the horsepower requirement would increase for the embodiment shown in FIG. 2. However, the ability to raise and lower the array 30 at slow speeds allows the use of relatively small motors in either embodiment.

As mentioned above, winch 21 may be a double drum traction winch consisting of power drums 21*a* and 21*b*, as shown diagrammatically in FIG. 4. While similar to the single drum (capstan) in FIG. 3, the double drum has several advantages. Line pull performance and speed capacity, like any traction winch, are unaffected by drum diameter or number of wraps on the drum. The double drum is a preferred design for applications where frictional coefficients between cable and drum are questionable or variable such as when the cable or drum surfaces are exposed to biofouling environments. A second benefit is the inherent fair leading feature of the grooved drum working in combination with fair leading rollers 24 making it unlikely for the cable to wrap over itself. Each of the two power drums 21*a* and 21*b* has multiple cable grooves. The grooves of the second drum 21*b* are offset in relation to the grooves first drum 21*a*. This allows for a very high wrap angle without producing the axial friction movement between the wraps which is inherent to the single drum traction winch of FIG. 3.

Figure 5:
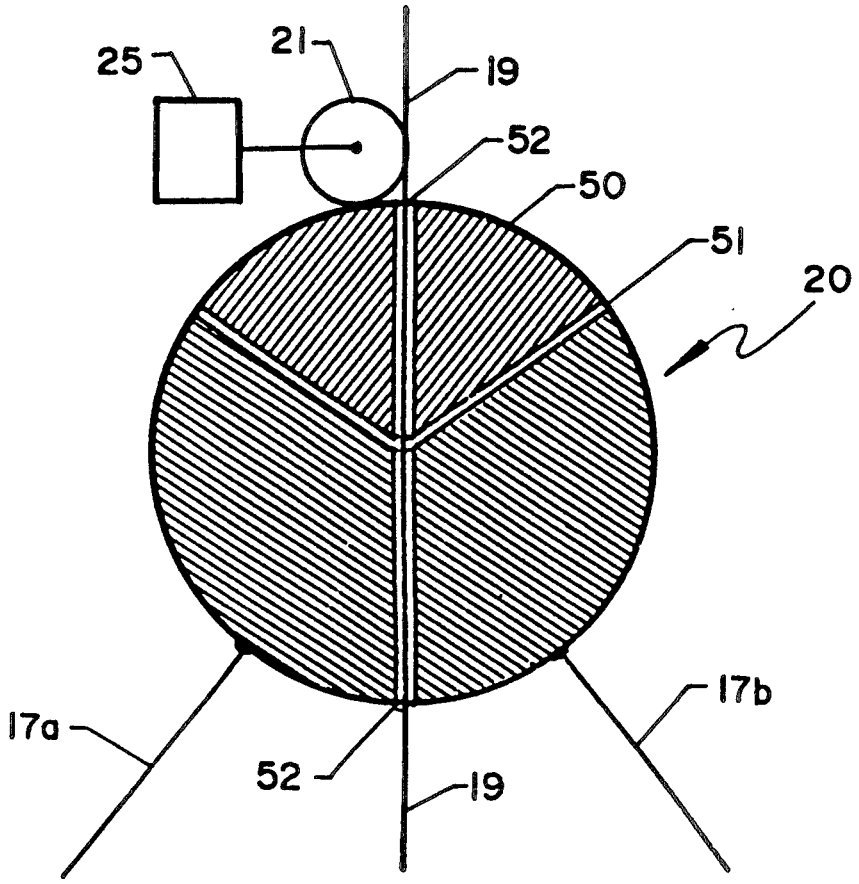
FIG. 5 is a cross-sectional view of an alternative main mooring buoy for the embodiment shown in FIG. 1.

The first embodiment of FIG. 1 may alternatively consist of a mooring buoy 20 having a funnel shaped plug 50 that fits into a conical hole 51 as shown in FIG. 5. A hole 52 passing through plug 50 and mooring buoy 20 allows mooring cable 19 to pass through. Traction winch 21 is mounted on top of plug 50. In this way a surface craft could pull the sensor 30, winch 21, motor 25 and signal cables 40 and 42 to the surface for repair/-maintenance.

The advantages of the present invention are numerous. By placing either a single or double drum traction winch at a mooring buoy, depth adjustment of a sensor array or any other underwater object is made possible. In a first embodiment, direct depth adjustment of the sensor array is provided requiring only a small lifting force and accordingly, a small drive motor. In a second embodiment, a slightly larger drive motor is required, however fewer mooring cables are required. Either embodiment provides a system for remote or deep water depth adjustment of a sensor array without the need for divers or submersible vehicles. Since no conventional long winding winches are used, the system is virtually jam proof.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system for mooring an object underwater and for adjusting a depth of said underwater object, said system comprising:

a plurality of mooring pads fixed to a sea bed;

a main mooring buoy located underwater;

a plurality of mooring cables in mechanical communication with said main mooring buoy wherein a first of said mooring cables is in mechanical communication with said underwater object and a remainder of said mooring cables are fixed to said mooring pads;

a floatation buoy attached to said underwater object for maintaining said underwater object afloat above said main mooring buoy means for adjusting the depth of said underwater object said adjusting means including a traction winch wrapped with said first mooring cable in mechanical communication with said underwater object, and located at said main mooring buoy and in mechanical communication with one of said plurality of mooring cables; and a counterweight attached to said first mooring cable for applying tension throughout said first mooring cable.

2. A system as in claim 1 further comprising means for rotating said traction winch whereby the depth of said underwater object is adjusted according to said rotation.

3. A system as in claim 2 wherein said rotating means is a motor.

4. A system as in claim 3 further comprising means for supplying power to said motor.

5. A system as in claim 4 wherein said power supplying means comprises an underwater power cable connected to said motor.

6. A system as in claim 1 wherein said traction winch is a single drum traction winch.

7. A system as in claim 1 wherein said traction winch is a double drum traction winch.

8. A system as in claim 1 wherein said main mooring buoy comprises:

a first buoy section fixably attached to the remainder of said mooring cables fixed to said mooring pads; and a second buoy section fixably attached to said traction winch and in removable communication with said first buoy section, said first and second buoy section having an orifice aligned on a common axis through which said first mooring cable may freely move whereby said traction winch and underwater object can be raised to the surface of the water without disturbing said main mooring buoy.

9. A system as in claim 1 wherein said adjusting means comprises:

a traction winch wrapped with one of said remainder mooring cables; and a counterweight attached to said one remainder mooring cable for applying tension throughout said one remainder mooring cable.

10. A system as in claim 9 further comprising means for rotating said traction winch whereby the depth of said underwater object is adjusted according to said rotation.

11. A system as in claim 10 wherein said rotating means is a motor.

12. A system as in claim 11 further comprising means for supplying power to said motor.

13. A system as in claim 12 wherein said power supplying means comprises an underwater power cable connected to said motor.

14. A system as in claim 13 wherein said underwater power cable comprises another of said remainder mooring cables.

15. A system as in claim 9 wherein said traction winch is a single drum traction winch.

16. A system as in claim 9 wherein said traction winch is a double drum traction winch.

* * * * *